US007247069B2

(12) United States Patent
Porat

(10) Patent No.: US 7,247,069 B2
(45) Date of Patent: Jul. 24, 2007

(54) FLOATING ELECTRONIC PLATFORM FOR SWIMMING POOLS AND SPAS

(75) Inventor: Joseph Porat, Delray Beach, FL (US)

(73) Assignee: Aquatron, LLC., Cedar Grove, NJ (US)

( * ) Notice: Subject to any disclaimer, the term of this patent is extended or adjusted under 35 U.S.C. 154(b) by 0 days.

(21) Appl. No.: 11/437,250

(22) Filed: May 19, 2006

(65) Prior Publication Data

US 2006/0223394 A1 Oct. 5, 2006

Related U.S. Application Data

(63) Continuation-in-part of application No. 10/292,793, filed on Nov. 12, 2002, now Pat. No. 7,089,876.

(51) Int. Cl.
*B63B 22/00* (2006.01)

(52) U.S. Cl. ..... 441/1

(58) Field of Classification Search ..... 441/1
See application file for complete search history.

(56) References Cited

U.S. PATENT DOCUMENTS 3,916,122 A * 10/1975 Sato et al. ..... 369/7
4,503,563 A * 3/1985 Johnson ..... 455/351
5,369,796 A * 11/1994 Kung ..... 455/344
6,525,762 B1 * 2/2003 Mileski et al. ..... 348/81
7,089,876 B2 * 8/2006 Porat ..... 114/222
2002/0054828 A1 * 5/2002 Keeping et al. ..... 422/63

* cited by examiner

*Primary Examiner*—Stephen Avila
(74) *Attorney, Agent, or Firm*—Abelman, Frayne & Schwab

(57) ABSTRACT

A stable, portable floating electronic platform is provided to enable wireless communications with at least one remote cellular phone while the platform is floating in a recreational water environment, such as a swimming pool or spa. The floating electronic platform includes a buoyant water-resistant housing having a lower portion that floats in the recreational water environment, and an upper surface that defines a sealed enclosure. The housing is configured with at least one water-resistant electronic device and adapted to provide power to each electronic device. The at least one water-resistant electronic device includes a wireless communications apparatus that is adapted to provide communications with one or more remotely located cellular phones within wireless communications range of the platform.

20 Claims, 11 Drawing Sheets

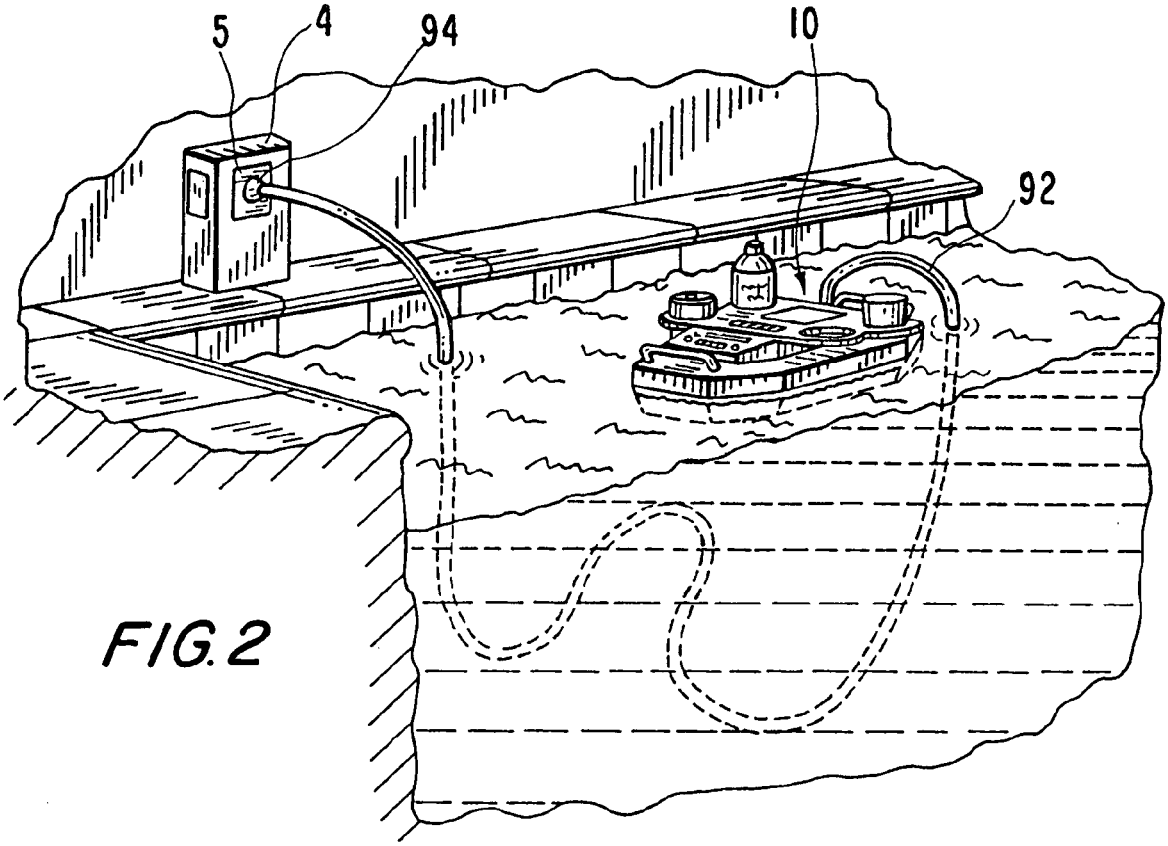
FIG. 2
FIG. 3
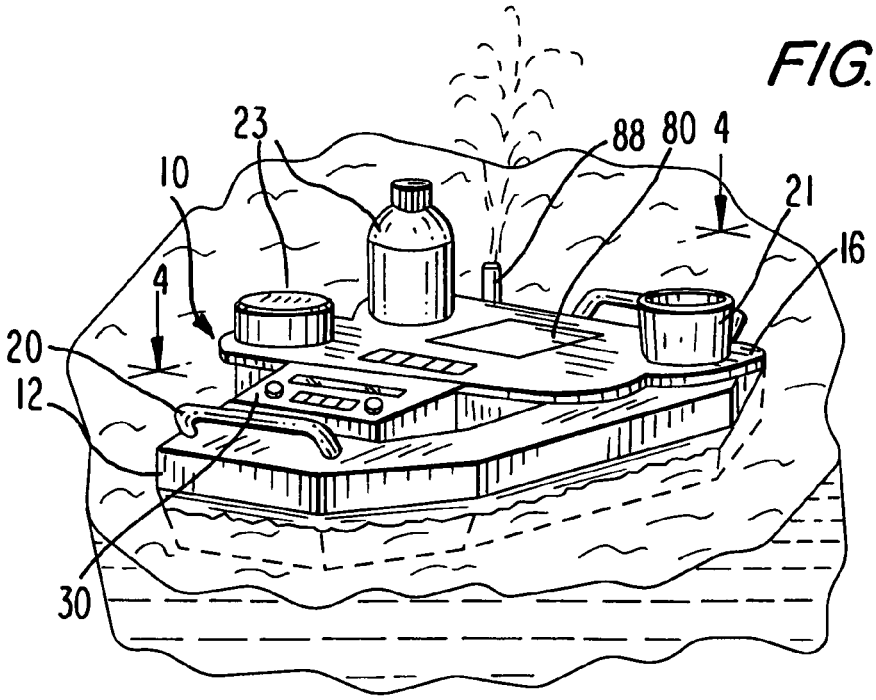

FIG.6
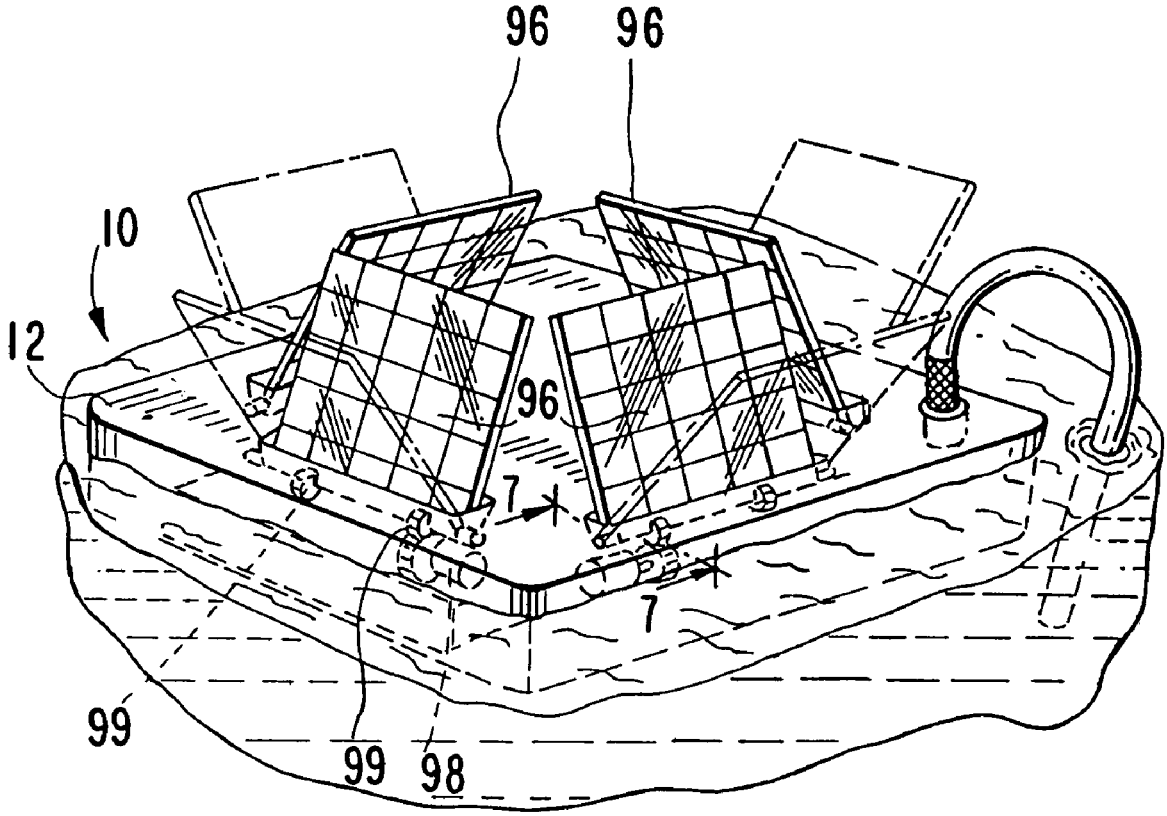
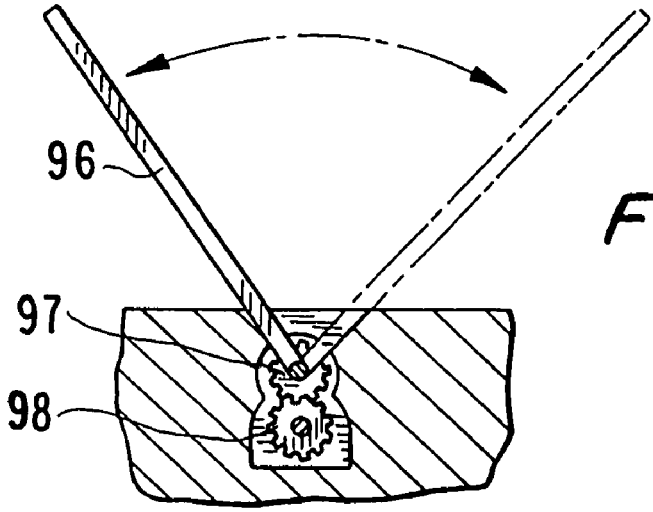
FIG.7

124

FLOATING ELECTRONIC PLATFORM FOR SWIMMING POOLS AND SPAS

CROSS-REFERENCE TO RELATED APPLICATION

This patent application is a continuation-in-part of U.S. patent application Ser. No. 10/292,793, filed Nov. 12, 2002, now U.S. Pat. No. 7,089,876, the contents of which are incorporated by reference herein.

BACKGROUND OF THE INVENTION

1. Field of the Invention

This invention relates to floating swimming pool accessories, and more specifically to a floating platform used to provide multi-media entertainment and wireless communications, among other leisure related applications and devices.

2. Description of Prior Art

Various floating accessories have been developed for use in swimming pools and other placid bodies of water to accommodate beverage cups and containers, sunglasses, sun tanning preparation containers and other small items utilized by bathers. For example, cup holders have been attached to floating chairs and lounge mats and to pool skimmers and similar floating filter devices.

Portable radios, with and without ear plugs have also been developed for use by bathers. However, due to their small size and limited battery power and capacity, these small portable radios of the prior art have a limited audible range and are generally limited to personal use.

Further, the floating electronic platforms of the prior art lack personalized features. For example, the selection of music is limited to tunable radio station channels that are broadcast over the air. However, some radio stations are undesirably inundated with commercials or subject to broadcast interference due to the topographical conditions, such as mountain ranges, tall buildings, power lines or broadcast range between the radio stations and the bather's pool.

The portability of cellular telephones has enabled users to conveniently conduct telephone calls from a wide variety of locations almost at will. Cellular phone calls can be made from the subway systems of New York, to the backyards of home owners in the suburbs, and to many rural locations, as additional cell towers are constantly being erected to close the communication gaps across the nation. A typical cell phone is generally not water-resistant, and cell phone owners either eschew or take precautionary measures when using the cell phone while in proximity of water. For example, a person relaxing in a swimming pool would normally exit the pool to make or receive a telephone call, which detracts from the mobility and convenience aspect of the cell phone, as well as the ability to relax in the pool while communicating with others.

It is therefore an object of the present invention to provide a floating platform or entertainment center that maintains and stores beverage containers, cups and other personal items, and that also includes various electronic entertainment devices capable of providing audio and/or video entertainment, such as music/voice or video signals to bathers in, and around the pool.

It is another object of the invention to provide a floating electronic entertainment station that includes a wireless communications network or personal local area network (plan) that will enable one or more persons to communicate with others through their portable mobile devices, such as cellular telephones, PDA's and the like, which are remote and safely located away from the swimming pool, but in wireless communication range of the floating electronic entertainment station.

SUMMARY OF THE INVENTION

The above objects and other advantages are attained by a buoyant article of manufacture that is provided with wireless communication means that permits signals between the floating platform and one or more cellular telephones or other wireless communication devices, e.g., PDAs, that are in transmission range. The floating platform is also preferably provided with one or more recesses for receiving any one or more of a variety of articles, such as cups, beverage containers and various other small items customarily used by bathers, as well as various other electronic devices such as an entertainment system that can include audio devices, such as a radio, a tape player, a CD player, a digital audio player (e.g., MP3 player and the like), among other devices, as well as a speaker system having the capacity to produce output signals that are audible to bathers and others who are alongside or in a natural or man-made recreational water environment, such as a pond, lake, swimming pool, hot tub or a spa. Other electronic devices can include video entertainment devices, such as a display panel that is capable of displaying video images from, for example, a DVD player, television signals, web browsers, and the like.

The external appearance and configuration can assume that of a boat, ship, a marine creature, a space ship, or any other configuration within the imagination of commercial and industrial designers and the artists. The floating electronic platform is provided with ballast as required to render it stable under the conditions that can be anticipated for use in a swimming pool, hot tub or spa. Other design features, including the size of recesses to hold beverage containers, cups, coffee mugs, electric devices, and the like will be readily apparent to one of ordinary skill in the art.

In a preferred embodiment, the audio and/or video entertainment devices are contained in a waterproof enclosure or compartment of the housing and include manually operable external control elements that are entirely waterproof and that can withstand at least a brief emersion in the event that the article is capsized, splashed with water or temporarily submerged when being place in, or removed from the pool or spa. The electronic devices can be removable from waterproof compartments for maintenance or replacement. Compartment access closures can be provided with gaskets, o-rings and other seals well known in the art. The closures can be secured by screws and/or manually releasable fasteners.

In one preferred embodiment, a stable, portable floating electronic platform is provided to enable wireless communications with at least one remote cellular phone while the platform is floating in a recreational water environment, such as a swimming pool or spa, or a larger body of placid water used by bathers. In particular, the electronic devices include a wireless communications apparatus that is adapted to provide communications with one or more remotely located cellular phones, PDAs or other voice and data communication devices that are within wireless communications range of the platform.

In view of its widespread adoption and growth, the BLUETOOTH specification for a wireless personal area network, or WPAN, as developed by the Bluetooth Special Interest Group will be described as the preferred embodiment for the practice of the invention. For additional information about the Bluetooth specifications visit www.bluetooth.com.

In one embodiment, a BLUETOOTH base is placed in the water-resistant housing to enable communications with the cellular phones that are in communication range in accordance with conventional BLUETOOTH standards to enable a bather to use the cellular telephone without having to exit the pool or spa. In another embodiment, a general-purpose computer is placed in the housing and includes a BLUETOOTH module, and other required hardware and software components to enable a bather to interact with a remotely located cellular telephone without having to exit the pool or spa.

In yet another embodiment, a digital audio player (DAP) is provided in the floating platform to allow a bather to listen to voice or music from audio files that are stored in conventional and known file compression formats, such as MP3, WMA, and other file compression formats that may be developed in the future. In one embodiment, the digital audio player is in the form of an application program stored and executed on the general-purpose computer. In another embodiment, the digital audio player is a stand-alone device that includes conventional hardware and software components that enable the bather to select and play one or more audio files either through discrete speakers associated with the DAP, or preferably with speakers that are shared with other electronic devices installed on the platform.

In yet another embodiment, audio files can be downloaded to, or uploaded from the digital audio player by interfacing with the BLUETOOTH base and a remotely located cellular telephone that is within wireless communication range of the BLUETOOTH base. These embodiments, as well as other embodiments are discussed below in greater detail with respect to the drawings and detailed description of the invention.

BRIEF DESCRIPTION OF THE DRAWINGS

The invention will be described in further detail below and with reference to the attached drawing sheets in which:

FIG. 2 is a view similar to FIG. 1 showing another manner of using the platform;

FIG. 3 is a top front right side enlarged view of the floating electronic platform of FIG. 1;

FIG. 6 is a top side perspective view of another embodiment of a floating electronic platform of the invention;

FIG. 7 is a partial sectional view taken along line 7—7 of FIG. 6;

DETAILED DESCRIPTION OF THE INVENTION

Figure 1:
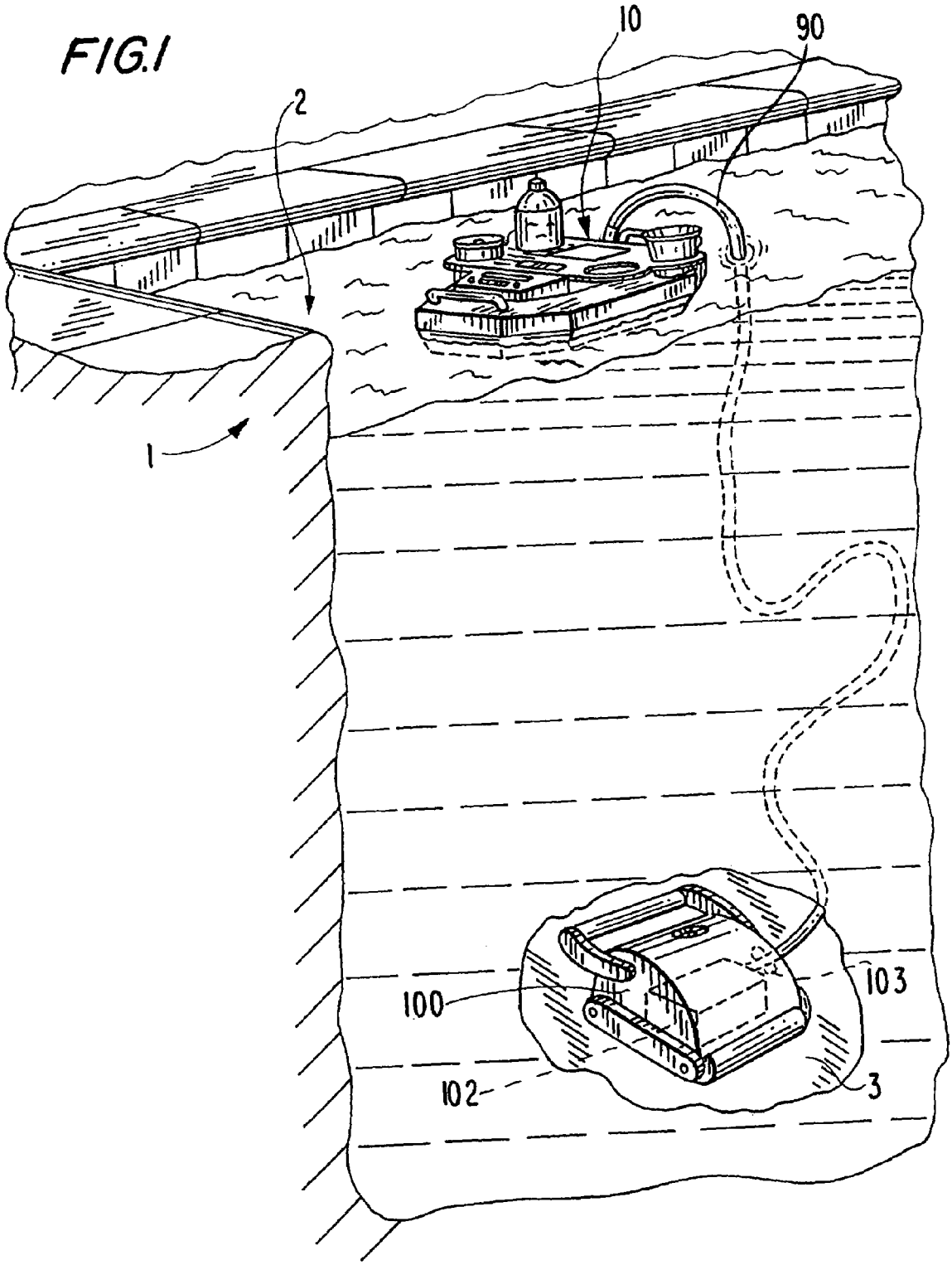
FIG. 1 is a perspective and partially cut-away view of one embodiment of a floating electronic platform of the present invention in use in a recreational water environment.

Referring now to FIG. 1, there is shown a schematic illustration of a portion of a recreational water container 1, such as a swimming pool, spa, hot tub, and the like, with one preferred embodiment of an entertainment platform 10 floating on the surface 2 of the pool. As will be described in more detail below, the electric power for platform 10 is supplied through a connecting power cable 90 that is attached to a robotic pool cleaner 100 that is positioned at the bottom surface 3 of the pool. The robotic cleaner 100 is powered by a rechargeable battery 102 that has a power input/output connector 103 on its exterior surface that is adapted to receive a mating connector on the end of cable 90.

Figure 4:
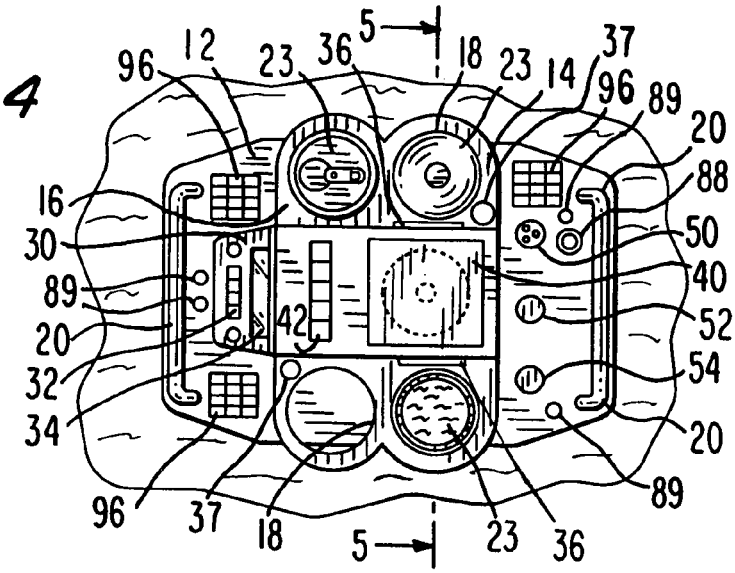
FIG. 4 is a top plan view of the platform in the direction of the arrows 4—4 of FIG. 3.
Figure 5:
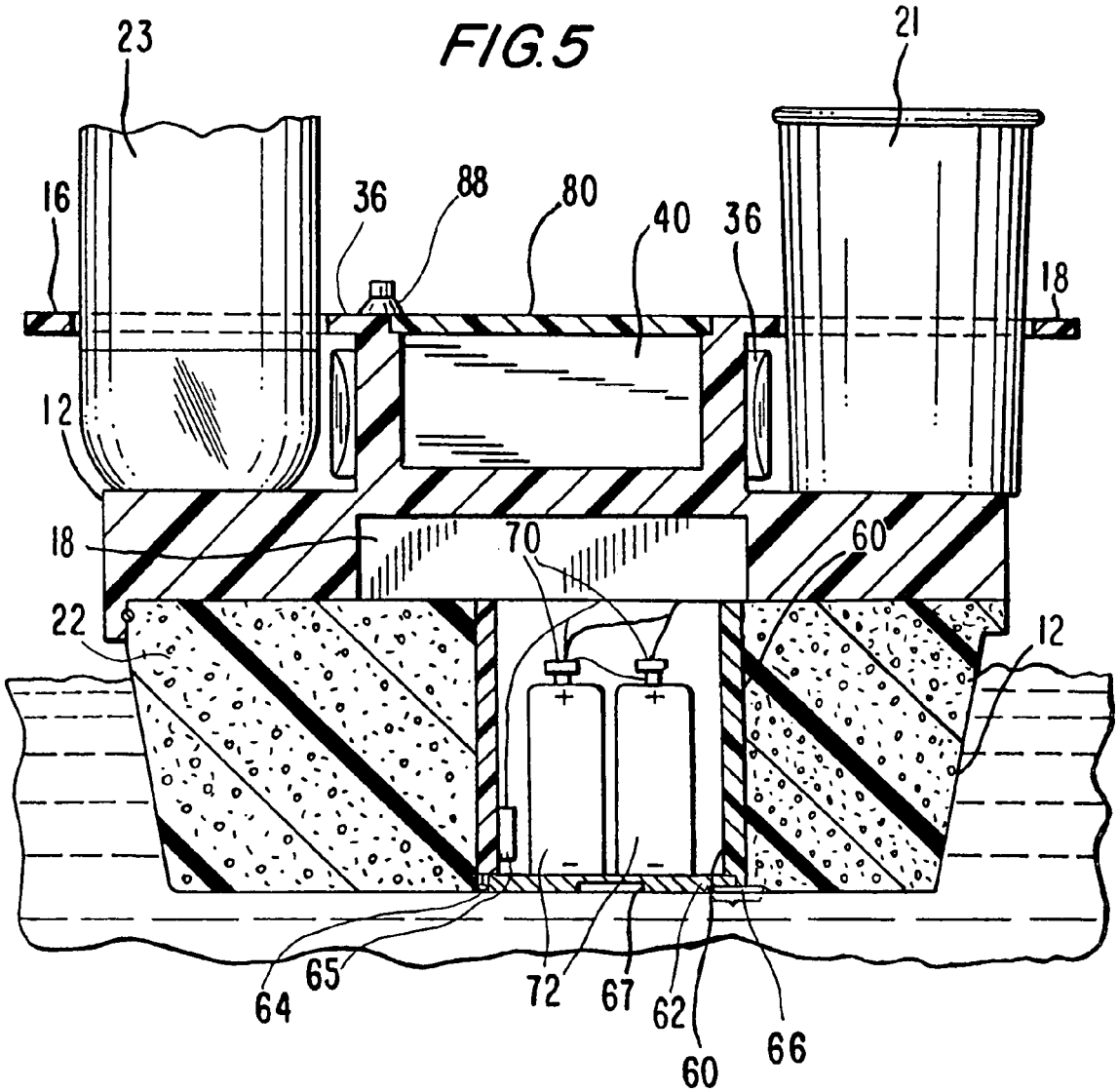
FIG. 5 is a cross-sectional view taken along lines 5—5 of FIG. 4.

In one preferred embodiment, as illustrated in FIGS. 1–5, the floating electronic platform 10 is set up for use as an in-pool entertainment center that is equipped with one or more electrically-powered audio devices. In the embodiment schematically illustrated in FIG. 2, the power to floating platform 10 is provided by a power cable 92 having a plug 94 that connects to a mating socket 5 in a conventional remote low-voltage power supply unit 4 located adjacent the pool. The power cable 92 is preferably of positive buoyancy and can float on the surface of the pool in order to minimize the vertical weight component on floating platform 10. However, as shown in FIGS. 2 and 5, a cable having negative buoyancy can be accommodated by providing appropriate flotation in the interior of the body 12 of platform 10.

For a more detailed description of the particular embodiment illustrated, reference will be made to FIGS. 3, 4 and 5. An outer housing or shell 12, which in the configuration shown has a generally planar upper surface and a rectilinear lower portion, can be fabricated from molded plastic as a unitary construction or assembled from components. However, as was made clear from the summary description of the invention provided above, the base or housing 12 can assume any configuration, including highly fanciful and stylized exterior shapes, the only limitation being that the complete article be stable when floating on the water's surface. As will also be understood by one of ordinary skill in the art, the buoyancy and placement of ballast, if necessary, must take into account the weight and placement of beverage containers, electronic devices and other items that may be stored in the unit above the water line. For example, a video electronic unit can be accommodated and its weight and center of gravity should be positioned to maintain stability.

Secured to the body 12 is a retaining platform 16 which is provided with a plurality of recesses or openings 18 to receive any of a variety of beverage containers 23, such as cans, bottles and cups 21.

The opposing ends of the illustrative platform include a pair of handles 20 to facilitate the movement, placement, and the removal and carrying of the platform in and outside of the pool. As will be understood by one of ordinary skill in the art, the housing or base 12 can also be provided with integrally molded handles, either in the form of projecting grips or recessed openings. A floating lanyard or tow rope can also be affixed to the platform to facilitate its movement and retrieval from outside of the pool using any of the long-handled tools customarily utilized for pool maintenance.

With continuing reference to FIG. 4, it will be seen that this embodiment is provided with an electronic entertainment unit 30 in the form of a radio having water-protected control elements 32 and display 34. As best seen in FIG. 5, a pair of waterproof speaker housings 36 is provided and connected both to the radio 30 and a CD player 40 located in a waterproof housing and covered by access panel 80. The platform can also be provided with one or more lights 37 that provide decorative and/or ambient illumination. The lights are preferably controlled by a photoelectric cell (not shown) to turn the lights on after dark and off in daylight. One skilled in the art will appreciate that other electronic entertainment devices can be provided, such a tape player, television, DVD player, among other electronic devices.

In one embodiment where a television tuner is provided, the access panel 80 over the CD player 40 can include a display panel for viewing video images. One skilled in the art will appreciate that the video display panel can be located elsewhere on the upper portion of the platform 10.

In yet another preferred embodiment illustrated in FIGS. 3, 4 and 5 the floating electronic entertainment center is provided with a conventional water pump and motor (not shown) that is connected to the rechargeable batteries 72 and to one or more water fountain jets 88 that extend through the surface of body 12. Water from the pool is drawn through an intake, presented by the pump and discharged into the air.

In a particularly preferred embodiment, one or more light sources, such as LEDs 89 are positioned adjacent the fountain jets 88 to illuminate the water spout and spray as it emanates from the fountain tip. This aspect of the invention provides a decorative effect that can be appreciated in the daylight by operation of the one or more fountains, and that is particularly pleasing after dark when the emitted water is illuminated by one or more colored light sources. As will be apparent to one of ordinary skill in the art, if a plurality of lights are utilized, changing patterns of illumination can readily be effected.

With further reference to FIG. 5, the battery compartment 60 is located in the lower portion of base 12 and surrounded by flotation material 22. This particular positioning permits the batteries 72 to function as ballast to stabilize the platform 10. Waterproof battery storage compartment 60 is accessed by closure 62, which in the embodiment shown is joined to the housing 12 by hinges 64 and secured by one or more latches 66. The handle 67 permits the closure to be lifted to access the batteries for maintenance and/or replacement. Electrical conductors 70 are joined to conventional circuitry for powering the audio components 30 and 40.

In a preferred embodiment, the platform is also provided with a safety shut-off switch 65 that can be activated by the incursion of water in the battery compartment 60 and/or by a mercury position switch that responds to a capsize or a lesser displacement from horizontal.

Again referring to FIG. 4, one or more connector outlets 50, 52 and 54 are provided on a conveniently accessible surface of housing 12. In this preferred embodiment, a plurality of connectors are provided to give maximum flexibility to the powering and use of the floating platform as a source of power to one or more other battery-powered devices. For example, one type of power cable 90 will be required when the floating entertainment unit is tethered to a battery-powered pool cleaner as was described in connection with FIG. 1. A different cable can be used when the unit is to be powered from a poolside power supply or other low-voltage power source. Alternate connector configurations can be accommodated in the plurality of input/output connectors 50, 52 and 54.

In a further preferred embodiment that will be described generally and with reference to FIGS. 4 and 5, the floating platform can also be provided with one or more solar power collecting panels 96. These panels can be mounted on any convenient surface which will be exposed to sunlight when the floating electronic platform is in the pool. For example, as shown in FIG. 4, a plurality of solar collector panels 96 are mounted in the surface of housing 12 where they are exposed to the maximum degree of sunlight. Alternatively, the cover 80 of compartment 40, best shown in FIG. 5, can incorporate the solar panels. Appropriate wiring (not shown) extends from beneath the solar panels 96 through conventional circuitry to provide a charging current to rechargeable batteries 72.

In yet another preferred embodiment of the invention illustrated in FIGS. 6 and 7, the floating electronic platform 10 serves only to support on body 12 one or more solar energy collector panels 96 that provide a recharging current to an on-board battery pack 72 or to a remote battery 102 such as that contained in submerged pool cleaner 100 as illustrated in FIG. 1. In this embodiment, the floating electronic platform provides a source of recharging current during the entire time that the solar collector panels are exposed to sunlight.

In accordance with methods that are well established in the art, the panels 96 can be pivotally and adjustably mounted in order to receive the maximum amount of solar energy during various seasons. By mounting a plurality of independent adjustable solar panels on the floating platform as shown in FIG. 6 and adjusting their position for the optimum seasonal solar rays, the maximum energy will be produced regardless of the orientation of the floating platform as it may be moved by wind or other influences on the surface of the pool. This method of gathering solar energy to provide a recharging current for batteries will provide a particular advantage during the long daylight hours of summer and in those latitudes where the intensity and duration of the sunlight is greatest and the use of the pool and its accessories is essentially year-round.

Various mechanical and electromechanical means for adjustably positioning the solar panels are known to the prior art. As best shown in FIG. 7, panels 96 are attached to rotatable supports 99 and moved by gears 97 driven by servo motors 98. Alternatively, manually adjustable supports relying on frictional attachment can be utilized.

When the floating electronic platform serves only to support a plurality of solar power collector panels for the purpose of providing a current to a remote rechargeable battery, the on-board circuitry can be limited to providing terminals extending from the solar panels to the underside of a power cable connector, e.g., connector 50. This will provide an efficient and low-cost apparatus for recharging the batteries of a self-propelled robotic pool cleaner, which cleaner is provided with the necessary circuitry to accept the current from the solar collectors 90.

In a further preferred embodiment, the necessary circuitry is incorporated into a modular unit that has connectors adapted to mate with conventional power cables known to the art. In yet a further preferred embodiment, a robotic pool cleaner is provided with the necessary on-board circuitry to permit recharging via the current collected by the solar panels and transmitted through cable 90, as shown in FIG. 1.

Further reference is made to FIG. 1 for the illustration of a pool cleaner 100 tethered to the floating electronic platform 10. In yet another preferred embodiment, the robotic pool cleaner 100 has no battery and receives its motive power from rechargeable batteries 72 located in the floating platform 10 via power cable 90. The power cable 90 can have neutral or positive buoyancy and the continuous tethering of the floating platform containing one or more solar panels does not impede the patterned movement of the self-propelled robotic pool cleaner during its submerged operations. Since the robotic cleaner has no battery, it is relatively lighter in weight than comparable cleaners that are provided with on-board rechargeable batteries, and therefore more easily transported for storage and maintenance outside the pool.

In another embodiment of the invention, the electronic floating platform 10 is provided with wireless voice and data communication technology, such as BLUETOOTH technology, to enable a bather to utilize a cellular phone via the electronic floating platform 10, while the cell phone is safely located away from the water in the vicinity of the pool 1 as shown, or at a more distant location (not shown). Depending upon the power class of the product, the transceiver microchip in the product can communicate in the range of from about 100 meters (Class 1), 10 meters (Class 2) or about one (1) meter (Class 3). The radio frequency transmissions do not require line of sight and will function even if the cellular phone is left inside the house, in an automobile or briefcase, so long as it is with the communication range. Thus, calls that otherwise might be missed or delayed will be signaled. In this manner, the bather can leisurely make or receive a wireless telephone call from the swimming pool 1, without having to exit the pool or potentially damage the cellular phone by dropping it into the pool.

Figure 8:
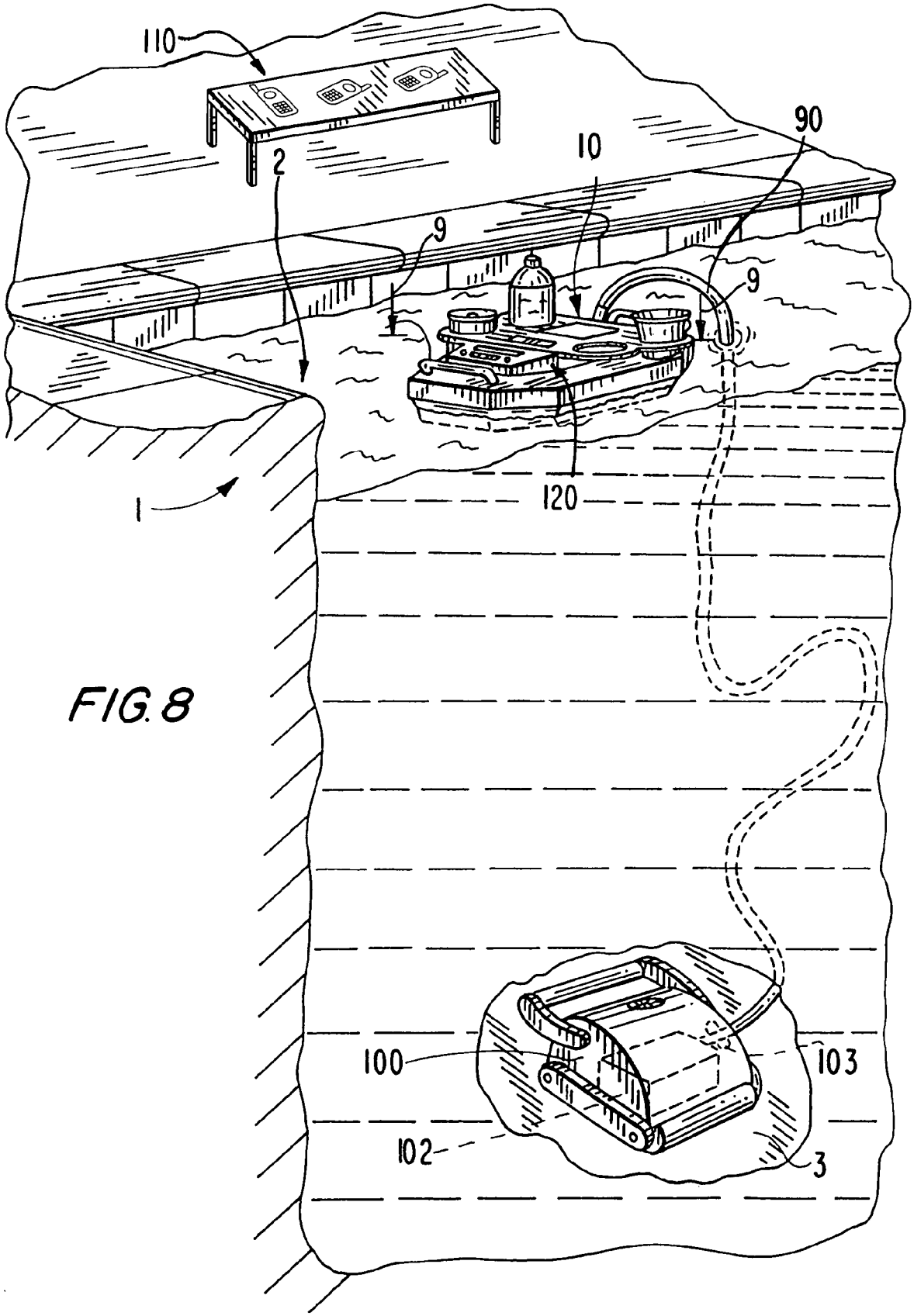
FIG. 8 is a perspective and partially cut-away view of another embodiment of the floating electronic platform of the present invention in use in a recreational water environment.

Referring to FIG. 8, the platform 10 is shown floating on the surface 2 of the water in the pool 1, as discussed with respect to FIG. 1. Several cell phones or PDAs 110 are shown in proximity of the swimming pool 1, for example, on a poolside table or other safe and dry location. The electronic floating platform 10 includes a wireless communications device 120, such as a BLUETOOTH module, which enables a bather to communicate with a cell phone 110 that is paired with the BLUETOOTH module, as described below in further detail.

BLUETOOTH technology allows two BLUETOOTH enabled devices within proximity of each other to communicate with one other wirelessly. (See, e.g., http://www.Bluetooth.org; "Specification of the Bluetooth®. System," Covered Core Package, v.1.2, Nov. 5, 2003, the disclosure of which is incorporated herein by reference.) The BLUETOOTH technology provides a variety of improvements over current wired solutions, such as hands-free communication and effortless synchronization.

The wireless communications apparatus 120 of the platform 10 relies on BLUETOOTH technology that is incorporated in both the BLUETOOTH base 130 and each of the plurality of BLUETOOTH enabled phones 110. BLUETOOTH technology is a well known standard for local wireless communication of portable devices, such as the plurality of BLUETOOTH enabled phones 110. The BLUETOOTH specification is publicly available at http://www.BLUETOOTH.org titled "Specification of the BLUETOOTH System", Covered Core Package, v.1.2, Nov. 5, 2003, incorporated herein by reference. There is also available a "Hands-Free Profile," Adopted Version 1.0, dated Apr. 29, 2003 that is published by the BLUETOOTH SIG, Inc., providing protocols on procedures in implementing a Hands-Free Profile, incorporated herein by reference (both the Hands-Free Profile and the Specification of the BLUETOOTH System are referred to as the "BLUETOOTH Specification").

Conventional hands-free solutions, for example, in automobiles have enabled drivers to use their mobile phones without hands by placing the mobile phone in a cradle that is connected to a hands-free system (typically a microphone and speakers wired together) in the automobile. These hands-free systems have been further enhanced using BLUETOOTH technology that requires no cradle since the cellular telephone equipped with BLUETOOTH is able to transmit data directly between the mobile phone and the hands-free system in the automobile. In these BLUETOOTH hands-free systems, a driver or passenger of an automobile having a BLUETOOTH enabled phone is able to automatically connect with the hands-free system in the automobile after the phone is undergoes a "pairing" procedure to identify the phone with the hands-free system the first time the phone is used.

Pairing requires that the mobile phone be "identified" by the hands-free system by undergoing a first-time pairing process that typically requires a scanning of devices by the hands-free system and then an identification of each paired device that is entered into the system. After the pairing process is completed, the mobile phone 110 and the base 130 automatically connect when they are within a predetermined range of one another. Typically, up to eight mobile phones can be paired into a BLUETOOTH base 130 at one time. An analogous procedure occurs with the apparatus of the present invention and the remote phones or other BLUETOOTH enabled devices.

Figure 9:
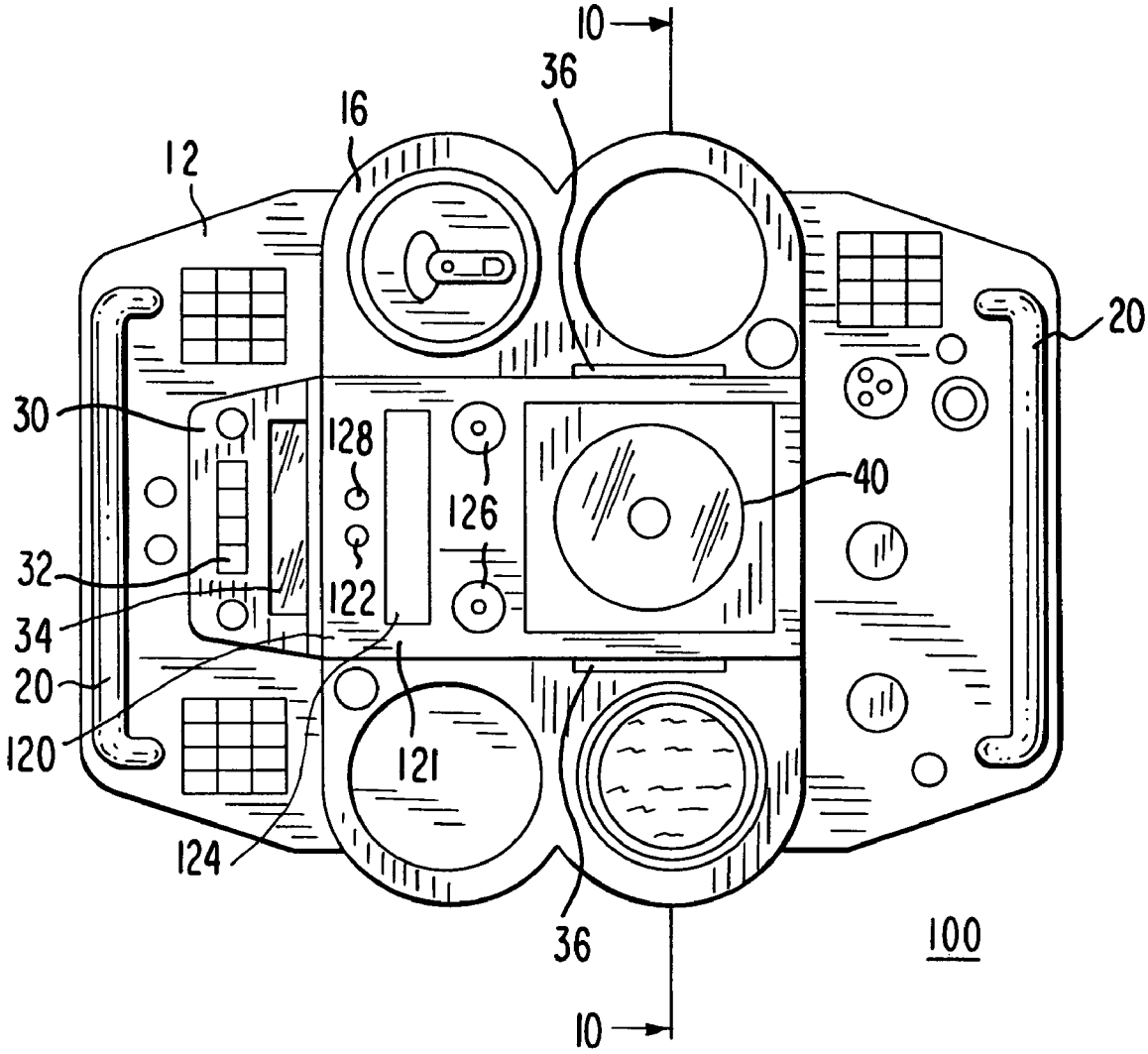
FIG. 9 is a top plan view of the platform in the direction of the arrows 8—8 of FIG. 8 illustrating a wireless communications center of the present invention.
Figure 10:
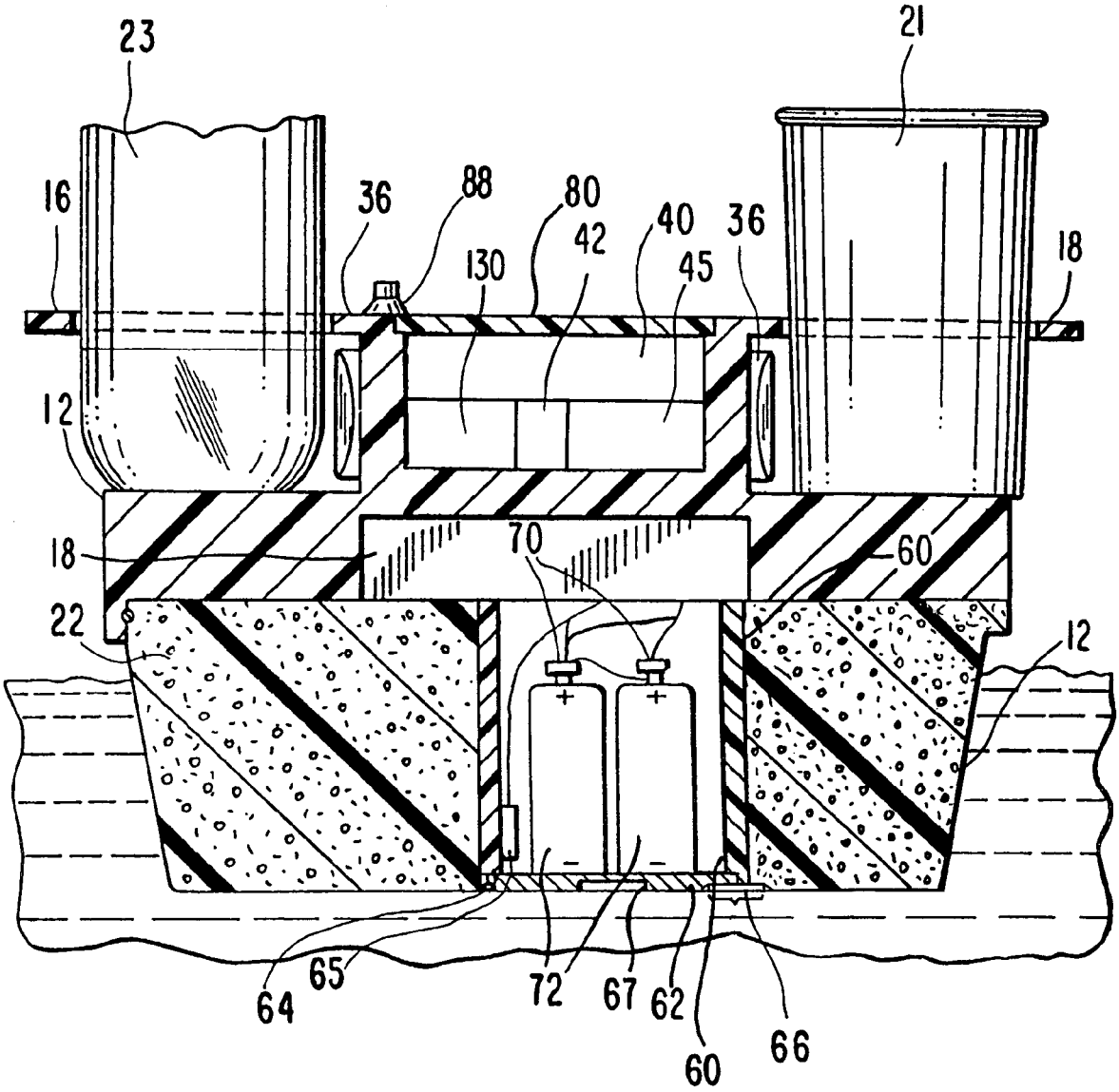
FIG. 10 is a cross-sectional view of the wireless communications center taken along lines 10—10 of FIG. 9.
Figure 13:
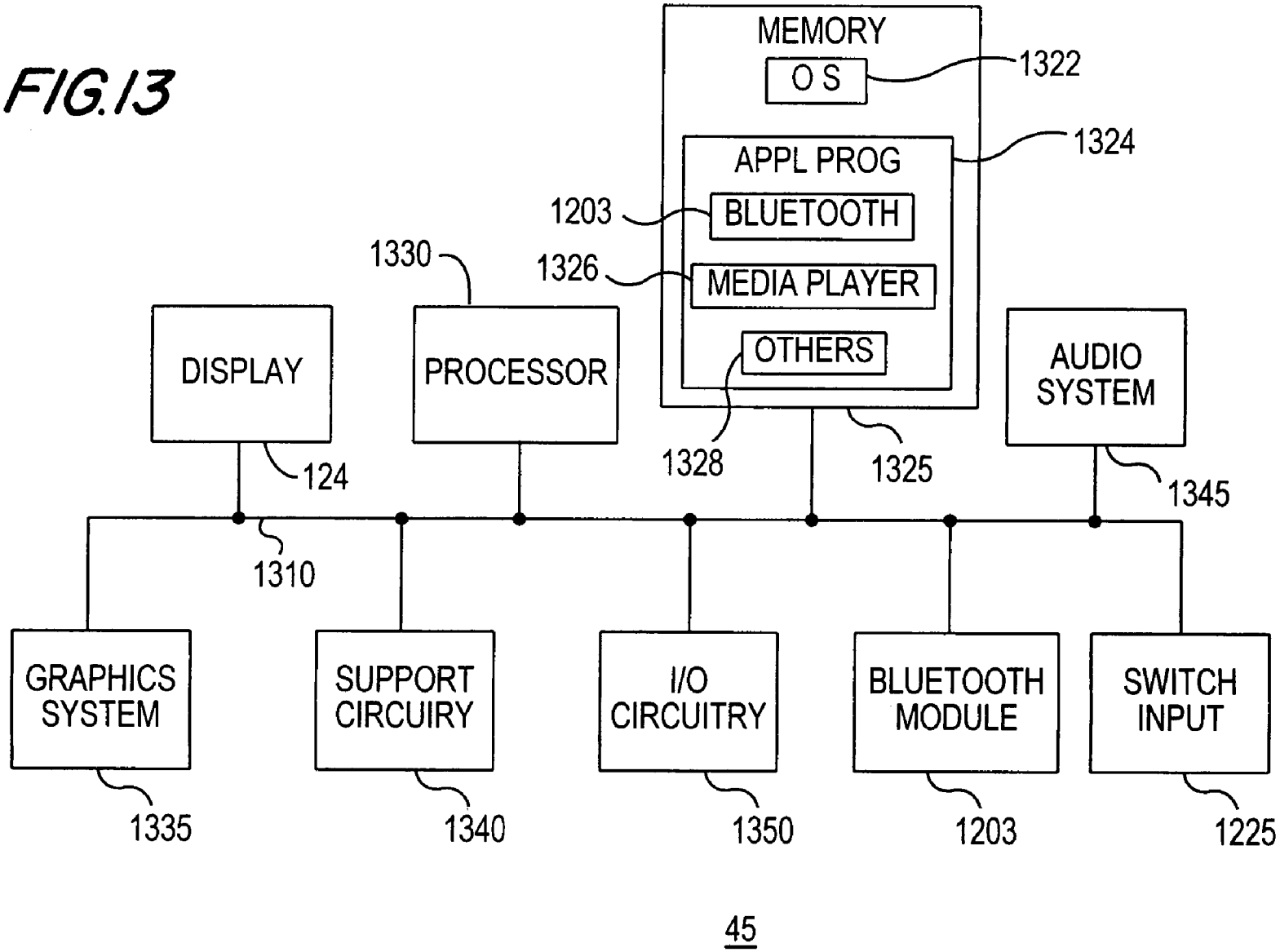
FIG. 13 is a functional schematic diagram of a general-purpose computer suitable for facilitating various features of the electronic floating platform of the present invention.

Referring to FIGS. 9 and 10, the electronic platform further includes a wireless communications center 120, such as a BLUETOOTH base 130 (FIG. 10) that interfaces with a plurality of peripheral input/output (I/O) devices 121, such as a microphone 122, a control and display panel 124, optional auxiliary waterproof speakers 126, and a headset connector (jack) 128. The BLUETOOTH base 130 is encased within the watertight walls of the retaining platform 16, for example, proximate the CD player 40 and/or radio 30, as shown in FIG. 10. In another embodiment, the BLUETOOTH base 130 can be integrated as part of another electronic device in the platform 10, such as the radio 30, or a general-purpose computer (FIG. 13).

The BLUETOOTH module 130 controls the interaction between the bather (i.e., user), the cell phone 110 and the I/O interfaces. Preferably, the I/O interfaces 121 are centrally located along the external surface of the retaining platform 16, and are protected from the water environment with a transparent plastic covering or by other conventional and widely known materials and modes of construction.

One or more BLUETOOTH enabled phones 110 are able to communicate with other BLUETOOTH enabled devices, such as the BLUETOOTH base 130 of the platform 10, whenever the BLUETOOTH enabled phones 110 are within communication range of the platform 10. Whenever any of the plurality of the BLUETOOTH enabled phones 110 are within the communication range of the BLUETOOTH base 130, a wireless communication is established with each of the plurality of BLUETOOTH enabled phones 110 after the process of "pairing" is performed, as described above.

Although the current BLUETOOTH Specification can only sustain a single communication link with a single phone at any one time, one skilled in the art will appreciate that the BLUETOOTH base 130 can include a selection mechanism that permits any one of the plurality of BLUETOOTH enabled phones 110 to be selectively chosen to establish a connection with the BLUETOOTH base 130. Each of the plurality of the BLUETOOTH enabled phones 110 contains a BLUETOOTH module that contains the BLUETOOTH technology for wireless communication described in the BLUETOOTH Specification cited above. Any mobile phone that contains the BLUETOOTH wireless communication module (e.g., FIG. 11) can be used.

In one embodiment, the BLUETOOTH base 130 is wired by conventional wiring into the power supply of platform 10 and also wired to the speaker 126, control/display panel 124, and the microphone 122. In this manner, the BLUETOOTH base 130 is able to provide communication signals from a bather in the pool or spa 1 through the microphone 122 that is electronically connected to the BLUETOOTH base 130, and through the BLUETOOTH enabled phone 110. From the BLUETOOTH enabled phone 110, the electronic signal is then transmitted by the BLUETOOTH enabled phone 110 using well-known cellular or satellite technologies.

In one embodiment, the auxiliary speaker 126 is any conventional waterproof audio speaker that can be mounted to the platform 10. In another embodiment, the speaker 126 is the same speaker (36) integrated with or used by other electronic devices of the audio system 30 installed in the platform, as discussed above with respect to FIGS. 3 and 4. Where the speakers 36 of the audio system 30 are used for cellular communications, a switching circuit and/or mechanism (not illustrated) is provided in, or as part of the BLUETOOTH base 130 to automatically interrupt or terminate audio output from the audio devices, such as the radio 30, CD player 40, and the like, and to permit audio communications from the BLUETOOTH base 130. In an alternative embodiment, the speaker 126 can be any portable (i.e. non-integrated) speaker, such as a headset, headphones, or ear plug that can be electrically connected to the platform 10 via the ear phone connector (jack) 128. Audio output from any non-integrated device would be reduced in volume or discontinued to permit the signal from the cellular phone to be more easily heard by bathers.

The microphone 122, much like the speaker 126, can be any conventional microphone that is able to receive voice signals from a bather while located in the pool 1 and transmit those electrical signals to another device, such as the BLUETOOTH base 130. The microphone 122 can be integrated into the platform 10, into the control/display panel 124, or can be a portable microphone. In another embodiment, all the components of the wireless communications center 120, including the speaker 126, the microphone 122 and the BLUETOOTH base 130, are able to communicate wirelessly, rather than being hard-wired together on the floating platform 10.

In operation, each of the plurality of BLUETOOTH enabled phones 110 must first undergo a process known as "pairing" as is generally described in the BLUETOOTH Specification. Generally, the pairing process is used to identify each of the plurality of BLUETOOTH enabled phones 110 by the BLUETOOTH base 130. The pairing procedures are typically performed only once for each new phone introduced to the BLUETOOTH base 130. Once the BLUETOOTH enabled phone 110 is paired with the BLUETOOTH base 130, the BLUETOOTH base 130 is able to identify each of the plurality of BLUETOOTH enabled phones 110 whenever any one of those phones 110 are within the communication range of the BLUETOOTH base 130. This identification is automatic and typically occurs when the BLUETOOTH enabled phones 110 are within the range and while the platform 10 is powered.

The pairing thus enables the BLUETOOTH base 130 to receive identification information for each of the plurality of BLUETOOTH enabled phones 110 so as to list each of the BLUETOOTH enabled phones 110 (that have been paired) on the display device 124 of the BLUETOOTH base 130. In one embodiment, the BLUETOOTH Specification provides for approximately eight (8) different BLUETOOTH enabled phones 110 to be listed or stored in the BLUETOOTH base 130. Should any additional phones need to be paired with the BLUETOOTH base 130, then other phones and their corresponding identification information can be deleted from the memory of the BLUETOOTH base 130 to make room for the new phones. Thus, in one embodiment, the BLUETOOTH base 130 has a display screen (described below) that displays a list of the identification information for each of the BLUETOOTH enabled phones 110. The identification information can be any information that uniquely identifies each of the plurality of BLUETOOTH enabled phones 110. Alternatively, the display 124 can list the phone with the highest priority under the BLUETOOTH specification, with which connectivity can be provided.

In one embodiment, the identification information is the device identification provided by a manufacturer for each phone. In an alternative embodiment, the identification information can be any information that uniquely identifies each of the plurality of BLUETOOTH enabled phones 110. For example, the identification information can be a unique phone number, serial number, or other manner of identifying each of the plurality of BLUETOOTH enabled phones 110 that will be paired. In addition, the BLUETOOTH base 130 allows, in alternative embodiments, for each of the BLUETOOTH enabled phones 110 to be uniquely named by the user.

Continuing in the operation of the wireless communications center 120 of the electronic floating platform 10 of FIG. 8, each of the plurality of BLUETOOTH enabled phones 110 have been paired with the BLUETOOTH base 130 and the identification information (that uniquely identifies each of the plurality of BLUETOOTH enabled phones 110 within the communication range) have been entered into the BLUETOOTH base 130. It is noted that the pairing procedure and other procedures for BLUETOOTH communication between the devices is already a standard in the BLUETOOTH Specification and no additional configuration must be done in order to permit the pairing or BLUETOOTH communication. In this way, the wireless communications apparatus of the invention benefits from ease of use of the standard protocol of the BLUETOOTH technology.

In one further embodiment, a selection mechanism can be provided with the BLUETOOTH base 130 to permit user selection of any one of the plurality of BLUETOOTH enabled phones 110 identified to be connected to the BLUETOOTH base 130. The selection is performed by a user interfacing with the BLUETOOTH base 130 either through a manual interaction or audio interface (e.g., voice activation) to select one of the identification information, and thereby make a connection with one of the plurality of BLUETOOTH enabled phones 110. Thus, in one embodiment, the BLUETOOTH Specification provides for the first BLUETOOTH enabled phone identified by the hands-free phone system to be automatically connected to the hands-free system. Alternatively, the wireless communications center 120 of the platform 10 allows any one of the BLUETOOTH enabled phones 110 to be paired with the BLUETOOTH base 130 and subsequently be selected and conveniently connected to a particular cellular phone 110, in accordance with procedures known in the art.

A user can select any one of a plurality of BLUETOOTH enabled phones 110 through the BLUETOOTH base 130. Preferably, the BLUETOOTH base 130 contains a control/display screen 124 that enables the user to select the identification information (corresponding to the BLUETOOTH enabled phone 110 that it wishes to connect to) by manually selecting (e.g., by pressing a button) the BLUETOOTH enabled phone 110 that the user wishes to connect to. The identification information that corresponds to each of the plurality of BLUETOOTH enabled phones 110 that have been paired with the BLUETOOTH base 130 can be reviewed through any type of manual selection mechanism, such as a button, or a scrolling mechanism, which permits all the identification information to be viewed for each of the plurality of the BLUETOOTH enabled phones 110. For example, a bather can scroll through the list of identification information for each of plurality of BLUETOOTH enabled phones 110 and select a phone that the bather wishes to connect to through the wireless communications center 120 of the platform 10.

In other embodiments, a bather can provide voice-activated communication signals through the microphone 122 in order to provide the identification information for the phone that the bather wishes to use. Using voice-activation, the wireless communications center 120 would audibly (through the speakers 36 or 126) pronounce the identification information, and the bather would respond, either through voice responses into the microphone 122, or by manual input through the scrolling, connecting and other button mechanisms. It is further understood that the identification information can also be any device identification number that is assigned to each device model. Once a bather selects the identification information and is connected to BLUETOOTH base 130, the bather is able to communicate with the wireless communications center 120 through the microphone 122 and speaker 126, and use the BLUETOOTH enabled phone 110 to communicate with others, as it is well known in the art.

By communication, it is understood that the base 130 transmits data and voice signals with the phones 110. In this manner, any of the personal data stored on the phone 110 can be communicated to the base 160. Such personal data can include the address book and phone numbers stored on the phones, or other data.

Figure 11:
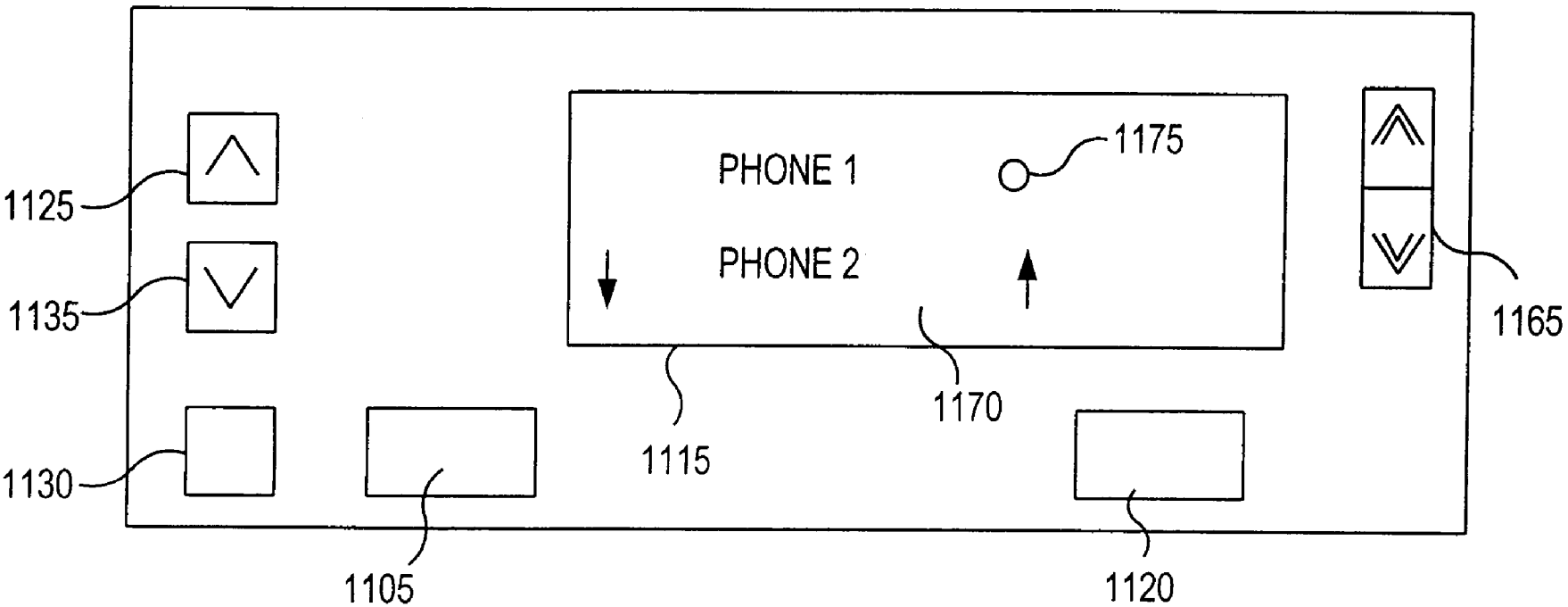
FIG. 11 is a schematic diagram view of an embodiment of a control and display panel of the wireless communications center of FIG. 9.

FIG. 11 is a schematic diagram of one embodiment of a control and display panel of the wireless communications center of FIG. 9. The illustrative embodiment of FIG. 11 is applicable for an embodiment where a bather can select a particular cell phone 110 from among a plurality of cell phones. The BLUETOOTH base 130 includes selection mechanisms in the form of manual buttons including scrolling-up button 1125, a connecting button 1130, volume control button 1170, and scrolling down button 1135. A display screen 1115, an end button 1120, and a send button 1105 complete the selection mechanisms and for a control panel of the BLUETOOTH base 130 in this embodiment. The send button 1105 allows the transmission of commands to the base 130.

The display screen 1115 visually provides the identification information that uniquely identifies each of the plurality of BLUETOOTH enabled phones 110 that have been previously paired to the BLUETOOTH base 130 as described above. Preferably, the display screen 1115 is a liquid crystal display (LCD) device, although other display devices can be utilized.

During operation, a bather wishes to connect to one of the plurality of BLUETOOTH enabled phones 110 that are within the communication range of the electronic floating platform 10. That bather scrolls the display screen 1115 by using the scrolling-up button 1125 or scrolling down button 1135 to locate the identification information that corresponds to the BLUETOOTH enabled phone 110 that the bather wishes to connect to the base 130. Once the identification information is found, the bather presses the connecting button 1130 and the BLUETOOTH base 130 connects the BLUETOOTH enabled phone 110 that corresponds to the identification information to the BLUETOOTH base 130. In this embodiment, the identification information is "phone-1" 1170, and in one embodiment, a conventional selection indicator, such as indicator light 1175 is used to indicate connectivity to a particular phone 110. One skilled in the art will appreciate that in other embodiments, the identification information can be a name, device identification number, model, manufacturer or other unique identifying information.

Figure 12:
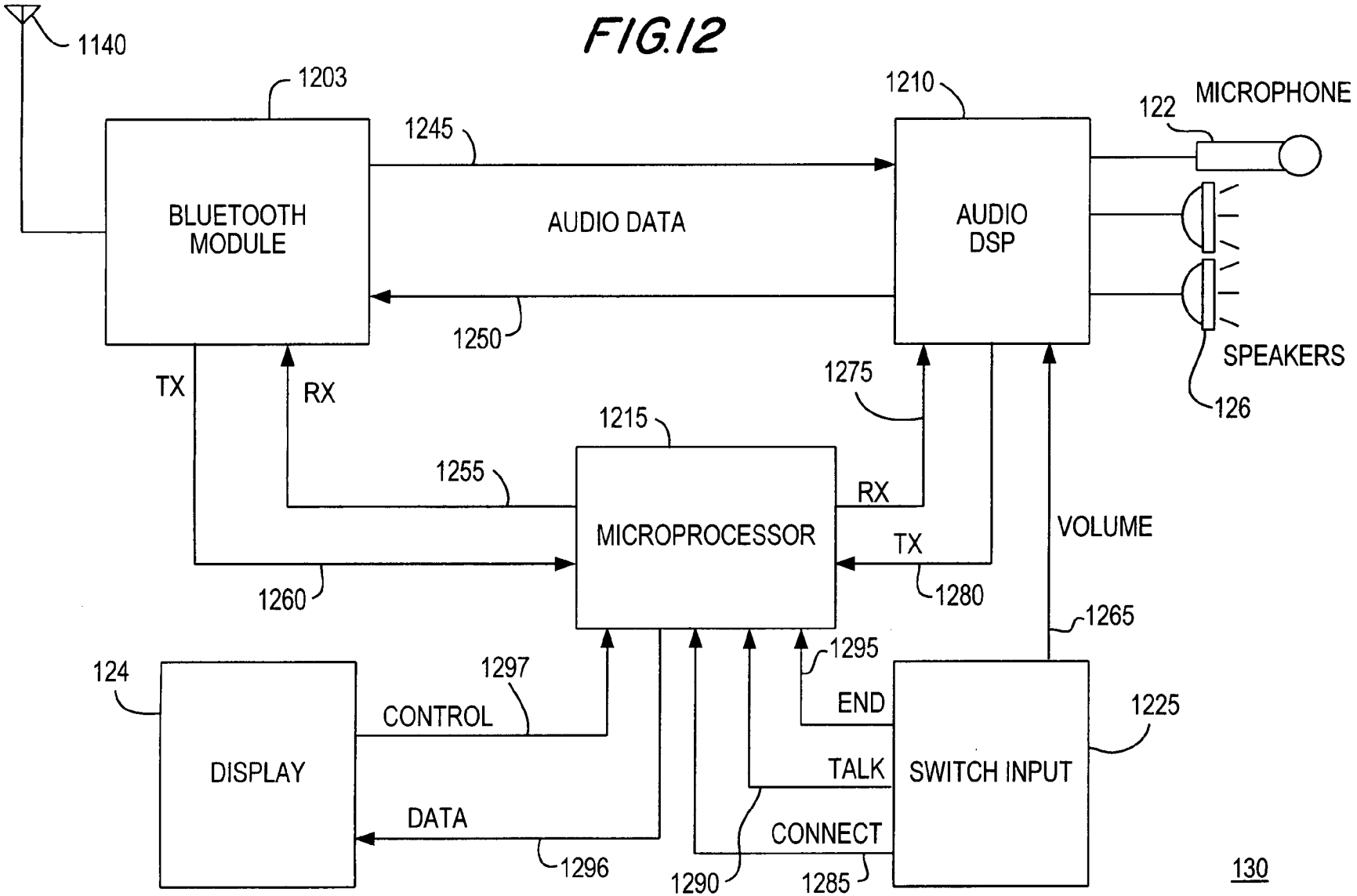
FIG. 12 is a schematic diagram view of the internal components of a BLUETOOTH base of the wireless communications center of FIG. 9.

FIG. 12 is a block diagram view of the internal components of an embodiment of the BLUETOOTH base 130 of the platform 10. The BLUETOOTH base 130 comprises a BLUETOOTH module 1203, a digital audio signal processor (DSP) 1210, a microprocessor 1215, an LCD display 124 and a switch input 1225. In this embodiment, the BLUETOOTH module 1203 includes the hardware and software that is set forth in the BLUETOOTH Specification that enables any electrical device equipped with the BLUETOOTH module 1203 to communicate with other BLUETOOTH enabled devices. Communications are provided through the BLUETOOTH antenna 1240, which transmits signals with the BLUETOOTH enabled phones (not shown).

The BLUETOOTH module 1203 communicates audio/data signals through communication lines 1245 and 1250 with the audio DSP 1210. These communication lines are, in one embodiment, wires. The audio DSP 1210 receives the audio data from the BLUETOOTH module 1203, as well as further information from the switch input 1225 and the microprocessor 1215 in order to transmit audio signals to and from the BLUETOOTH base 130, the speakers 126, and microphone 122. The audio DSP 1210 is electrically connected to the microprocessor 1215 and the switch input 1225 through communication wires 1275, 1280, and 1270. The communication wires 1270 allow the volume to be controlled on the BLUETOOTH base 130.

The switch input 1225 works with microprocessor 1215 to deliver electrical pulses corresponding to the selection mechanisms (talk, end, connect) to the microprocessor depending on which selection mechanism is entered by a user. The microprocessor 1215 then works with the display screen 124 through lines 1297 and 1296 in order to display any data such as the identification information to a user. It is to be understood that other embodiments of a BLUETOOTH base 130 can contain devices for voice-activated interaction rather than display screen interaction with a bather.

FIG. 13 is a functional schematic diagram of a general-purpose computer 45 suitable for facilitating various features of the electronic floating platform of the present invention. In one embodiment, the computer system is the BLUETOOTH base. In alternative embodiments, the computer system 45 can be integrated with other electronic components, such as the audio system 30 of the platform 10.

The computer system 45 includes a processor 1330 for executing program instructions stored in a memory 1320. In one embodiment, processor 1330 includes one or more processors 1330 that cooperate with support circuitry 1340, such as power supplies, clock circuits, graphics subsystems, audio subsystems, among other conventional support circuitry, to assist in executing software routines stored in the memory 1320. The computer 45 also comprises input/output (I/O) circuitry 1350 that forms an interface between various functional elements and peripheral devices communicating with the computer 45.

The memory 1320 stores instructions and data for execution by processor 1330, including instructions and data for performing the methods described above. Depending on the extent of software implementation in computer system 45, the memory 1320 stores executable code when in operation. The memory 1320 can include, for example, volatile memory, such as banks of read-only memory (ROM), dynamic random access memory (DRAM) as well as high-speed cache memory. The memory 1320 can further include non-volatile memory, such as a mass storage device, which can be implemented as fixed and/or removable medium, for example, as one or more magnetic, optical, or magneto-optical disk drives, or firmware, such as flash memory and the like. The drive is preferably a non-volatile storage device for storing data and instructions for use by processor 1330.

In one embodiment, the mass storage device stores client and server information, code for carrying out methods in accordance with exemplary embodiments of the invention, and computer instructions for processor 1330. In another embodiment, computer instructions for performing methods in accordance with exemplary embodiments of the invention also are stored in processor 1330. The computer instructions are programmed in a suitable language, such as Java, C or C++.

In one embodiment, the processor 1330 can operate in conjunction with a portable non-volatile storage medium, such as a CD-ROM, a portable memory stick, or other computer-readable medium, to input and output data and code to and from the computer system 45. Methods performed in accordance with exemplary embodiments of the invention can be implemented using computer instructions that are stored on such a portable medium and input to the computer system 45 via portable storage medium drive.

In one embodiment, an operating system 1322 and optionally, one or more application programs 1324 are stored in memory 1320. The operating system 1322 comprises program instruction sequences that provide services for accessing, communicating with, and controlling the computer system 45. The operating system 1322 provides a software platform upon which the application programs can execute, in a manner readily understood by those skilled in the art. The computer system 45 further comprises one or more applications 1324, such as program instruction sequences forming the BLUETOOTH module 1203 for selecting one of a plurality of BLUETOOTH enabled phones 110. Other application programs can include a media player 1326, among others 1328.

The computer system 45 can incorporate a combination of additional devices. These include, but are not limited to, a mass storage device, one or more peripheral devices, an audio subsystem 1345, one or more input/output devices 1350, one or more portable storage medium drives, a graphics subsystem 1335, and a display 124. The various components are connected via one or more appropriate buses 1310 as known by those skilled in the art. In alternative embodiments, the components are connected through other communications media known in the art. In one example, processor 1330 and memory 1320 are connected via a local microprocessor bus, while the mass storage device, peripheral devices, portable storage medium drives, and audio and graphics subsystems are connected via one or more input/output buses.

The peripheral devices can include any type of computer support device, such as an input/output (I/O) interface, to add functionality to computer system 45. The peripheral devices also include input devices to provide a portion of a user interface and can include an alphanumeric keypad or a pointing device such as a trackball, a stylus, or cursor direction keys, among other input devices. The I/O interface comprises conventional circuitry for controlling input devices and performing particular signal conversions upon I/O data. The I/O interface can include, for example, a keyboard controller, a serial port controller, and/or digital signal processing circuitry.

The graphics subsystem 1335 and the display 124 provide output alternatives of the system. The graphics subsystem 1335 and display 124 include conventional circuitry for operating upon and outputting data to be displayed, where such circuitry preferably includes a graphics processor, a frame buffer, and display driving circuitry. The display 124 can include a liquid crystal display (LCD) or other suitable devices. In one embodiment, the display screen of the BLUETOOTH base 130 is an LCD screen. The graphics subsystem 1335 receives textual and graphical information and processes the information for output to the display 124. The display 124 is illustratively used to display the GUI of FIG. 11.

The audio subsystem 1345 preferably includes a sound card that receives audio signals from a peripheral microphone. In addition, the audio subsystem 1345 can include a processor (such as DSP 1210) for processing sound. The signals can be processed by the processor in the audio subsystem 1345 of computer system 45 and passed to other devices as, for example, streaming audio signals.

In other embodiments, programs for performing methods in accordance with exemplary embodiments of the invention are embodied as computer program products/mediums. These generally include a storage medium or medium having instructions stored thereon used to program a computer to perform the methods described above. Examples of suitable storage medium or media include any type of disk including floppy disks, optical disks, DVDs, CD ROMs, magnetic optical disks, RAM, EPROMs, EEPROMs, magnetic or optical cards, hard disk, flash card, smart card, and other medium.

Stored on one or more of the computer readable medium, the program includes software for controlling both the hardware of a general purpose or specialized computer or microprocessor. This software also enables the computer or microprocessor to interact with a human or other mechanism utilizing the results of exemplary embodiments of the invention. Such software includes, but is not limited to, device drivers, operating systems and user applications. Preferably, such computer readable medium further includes software for performing the methods of operation. Accordingly, the electronic floating platform 10 can facilitate a general purpose computer 45 to provide audible, visual, and wireless communication features to one or more bathers while relaxing in their swimming pool or spa 1.

Referring to FIG. 10, in yet another embodiment of the present invention, the electronic floating platform 10 includes a digital audio player 42 which stores audio files in memory that can be selected by the bather and played through the speaker system 36. Digital audio players can be in the form of software, hardware or a combination thereof. Software based digital audio players are commonly termed as "media players," and include REALPLAYER, WINDOWS MEDIA PLAYER and ITUNES, among other well known media players. The media player is illustratively shown in FIG. 13 as an application program that plays audio files which are in an encoded format, such as MP3, AAC and WMA, among others.

Referring to FIG. 13, in an embodiment where the floating electronic platform 10 includes a computer system 45, a media player 1326 is shown as being one of the application programs stored in memory 1320. Audio files, such as music files, and preferably compressed audio files, such as MP3 format files are downloaded in accordance with the invention by wireless communications (e.g., BLUETOOTH) into the memory (e.g., flash memory, disk drive, and the like) 1220 of the computer 45. The user utilizes the media player 1326 to select and play one or more audio files in a conventional manner.

Alternatively, in an embodiment where the floating platform 10 does not include a general-purpose computer as shown in FIG. 13, a separate music player is provided in the platform 10. The music player includes hardware and software components to store, select and play audio files, and can take the form of either hard-drive based players, CD players 40, or flash-based players, as is well known in the art.

Figure 14:
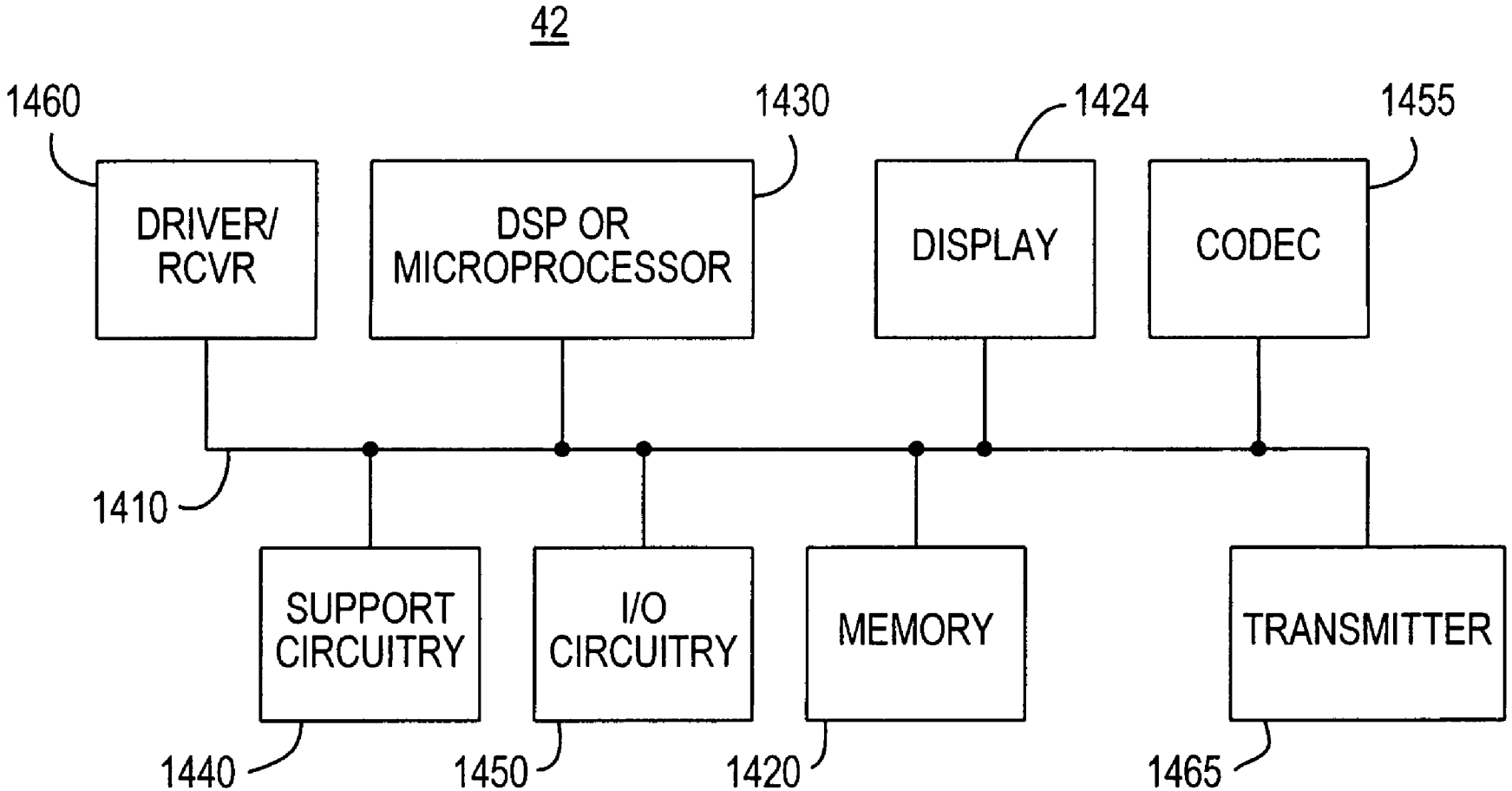
FIG. 14 is a functional schematic diagram of the internal components of a digital audio device suitable for use with the floating electronic platform of FIG. 8.

FIG. 14 is a functional schematic diagram of the internal components of a digital audio device 42 suitable for use with the floating electronic platform 10 of FIG. 8. The digital audio device 42 comprises a micro-controller or DSP 1430, a CODEC 1455, memory 1420, support circuitry 1440, I/O circuitry 1450, a display 1424, an optional receiver 1460, an optional transmitter 1465, and communication lines 1410 to exchange information between the components in a conventional manner. The micro-controller 1430, memory 1420, support circuitry 1440, I/O circuitry 1450, display 1424 and communication lines 1410 operate in a similar manner as discussed above with respect to the computer system 45 of FIG. 13.

In particular, the micro-controller 1430 controls downloading of audio files, as well as the playing of the files in response to user commands, illustratively provided by buttons controlling the I/O circuitry 1450 or control features provided on the display 1424. In one embodiment, the display 1424 is an LCD screen that is integrated with the audio unit 30 of the platform 10.

The memory 1420 is preferably non-volatile memory, such as discrete or removable flash memory, a disk drive, and the like. The compressed music files are stored on the memory by either downloading the files, or in the case where the memory is removable flash memory, preloading the audio files on the removable flash memory.

The CODEC 1455 decompresses an audio file selected from memory 1420 into an audio stream for play-out over output devices, such as the speakers 36 or headset. Typically, the decompressed audio stream is amplified prior to being played over the speakers 36.

In one embodiment, the digital audio device 42 is integrated with the computer 45 or other electronics, such as the radio 30. Alternatively, the digital audio device 42 is a discrete device that stores and plays audio files of a particular format in a conventional manner.

In one embodiment, the digital audio player 42 includes a wireless receiver for downloading the audio files over a wireless network, such as the BLUETOOTH network or another network operating at different (e.g., higher) frequencies. Accordingly, a bather can download audio files to the digital audio player 42 of the floating platform 10 via a cellular telephone 110. In particular, the bather can connect to a cellular telephone in communications range of the floating platform 10 via the BLUETOOTH network, as discussed above with respect to FIGS. 12 and 13, and then access a private or public network, such as the Internet, in a conventional manner. Downloads to the floating platform can also be made from a Bluetooth-enabled computer that is in range, e.g., from a poolside laptop or from a desktop computer in a room in the house of a residential pool.

In yet another embodiment, a wireless transmitter 1465 can be provided to allow a bather to transfer (upload) audio files from the memory 1420 of the digital audio player 42 to a remote location, for example, via a private or public network. In particular, the bather can use the BLUETOOTH capabilities of the platform 10 in conjunction with a cell phone 110 to upload audio files and transmit audio files across the cellular network, and optionally the Internet, to a final destination in a well-known manner.

Accordingly, the present invention enables a bather relaxing in a swimming pool, spa, or even in the water of a lake or other placid body of water, to make and receive cellular telephone calls conveniently from the electronic floating platform 10. The cellular telephone feature provided by the platform 10 is enabled by the inclusion of a short range wireless communication device, such as that of the BLUETOOTH hardware and/or software, in order to provide communication between one or more cell phones 110 and the platform 10. The floating platform can be entirely self-contained with rechargeable batteries as the power supply. Alternatively, power can be supplied from a conventional unit or a tethered pool cleaner.

Additionally, the platform can include a digital audio player, either in the form of software (e.g., a media player) or a combination of hardware and software (e.g., a music player). The digital audio player can be incorporated into a radio or audio center 30 or be a stand-alone device that is installed in the platform 10. Various formatted audio files can be provided to the digital audio player by communications over a wired or wireless network, or via a removable memory device, such as a portable memory stick or jump drive. Similarly, audio files can be uploaded over by communications over a wired or wireless network, or via a portable memory device.

One skilled in the art will appreciate that other types of files, such as data and video files can be uploaded and downloaded between the platform 10 and any other device having BLUETOOTH capabilities that is in communications range with the platform. For example, a laptop computer (or desktop computer) can be in communications range of the platform, illustratively, in a bedroom or home office that is in vicinity of the pool. Accordingly, files can be exchanged between the computer device and platform using the BLUETOOTH communications medium, as discussed above.

Although the floating platform has been described having both BLUETOOTH and multimedia devices (e.g., digital audio player, radio, and the like), one skilled in the art will appreciate that the floating platform can include the multimedia entertainment devices, such as a digital audio player (e.g., MP3 player) without having BLUETOOTH capabilities. Conversely, the floating platform can include the BLUETOOTH device described above without the multimedia devices, such as a radio, digital audio player, and the like.

As will be understood from the above descriptions of the several preferred embodiments, various modifications and additions can be incorporated into a floating electronic platform that will be within the skill of the art. The scope of the invention is therefore to be determined with reference to the claims which follow.

I claim:

1. A portable floating electronic platform for recreational use in a swimming pool or water environment comprising:

a buoyant water-resistant housing having a lower portion that floats in the water and an upper surface that defines a sealed enclosure, said housing having a power supply and a water-resistant wireless communications apparatus for providing at least audio communications with one or more remotely located cellular phones within wireless communications range of the platform.

2. The floating platform of claim 1, wherein said wireless communications apparatus comprises a BLUETOOTH base transmitter and receiver operatively coupled to at least one speaker and a microphone for establishing voice communications between said platform and one of said one or more remote cellular phones.

3. The floating platform of claim 2, wherein said BLUETOOTH base comprises a BLUETOOTH module, a microprocessor and a digital audio signal processor (DSP) adapted to communicate signals with each other for automatically pairing the cellular phones with the base and enabling communications between the BLUETOOTH base and one of said cellular phones.

4. The floating platform of claim 3, wherein said base comprises a console with an audio signaler, and/or a display and controls for enabling user interaction to control the communications with the remote cell phone.

5. The floating platform of claim 4, wherein communications between the base and one of said cellular phones is based on a last performed pairing between the base and the cellular phone.

6. The floating platform of claim 4, wherein communications between the BLUETOOTH base and the cellular phones is user selectable.

7. The floating platform of claim 4, wherein said display includes an LCD display panel.

8. The floating platform of claim 6, wherein said audio signaler and/or display provide identification information associated with said one or more cellular phones.

9. The floating platform of claim 8, wherein said controls comprise means for selecting one of said cellular phones for communications.

10. The floating platform of claim 9, wherein said means for selecting comprises at least one of voice commands and manual input.

11. The floating platform of claim 2, wherein said BLUETOOTH base is operatively integrated with at least one other electronic device enclosed in said housing.

12. The floating platform of claim 11, wherein said at least one other electronic device comprises a general-purpose computer.

13. The floating platform of claim 12, wherein said BLUETOOTH base is integrated with said general-purpose computer device enclosed in said housing.

14. The floating platform of claim 2, wherein said at least one speaker is integrated as an audio output device with at least one other electronic device on board the platform.

15. The floating platform of claim 2, wherein said at least one other electronic device includes a digital audio player for storing and playing standard and compressed audio files over at least one speaker.

16. The floating platform of claim 15, wherein said digital audio player is integrated with another electronic device on board the platform.

17. The floating platform of claim 15, wherein the player is integrated with a general-purpose computer device.

18. The floating platform of claim 15, wherein the wireless communications apparatus has control means for downloading audio files from one of said cellular phones to said digital audio player.

19. The floating platform of claim 15, wherein the wireless communications apparatus has control means for uploading audio files from said digital audio player to one of said remote cellular phones for transmission to a predetermined destination.

20. The floating platform of claim 2 further comprising at least one of a radio, tape player, CD player, television and DVD player installed in said housing.

* * * * *